US007954303B2

(12) United States Patent
Farneti

(10) Patent No.: US 7,954,303 B2
(45) Date of Patent: Jun. 7, 2011

(54) MACHINE FOR COVERING VARIOUS TYPES OF ARTICLES

(75) Inventor: Aldo Farneti, Milan (IT)

(73) Assignee: Colibri' System S.p.A., Milan (IT)

( * ) Notice: Subject to any disclaimer, the term of this patent is extended or adjusted under 35 U.S.C. 154(b) by 0 days.

(21) Appl. No.: 12/223,868

(22) PCT Filed: Jul. 10, 2006

(86) PCT No.: PCT/EP2006/064045

§ 371 (c)(1),
(2), (4) Date: Sep. 25, 2008

(87) PCT Pub. No.: WO2007/096005

PCT Pub. Date: Aug. 30, 2007

(65) Prior Publication Data

US 2009/0193768 A1 Aug. 6, 2009

(30) Foreign Application Priority Data

Feb. 20, 2006 (IT) ..... MI2006A0303

(51) Int. Cl.
*B65B 31/00* (2006.01)
*B42C 5/00* (2006.01)

(52) U.S. Cl. ..... 53/131.1; 53/411; 53/389.3; 493/341; 412/24

(58) Field of Classification Search ..... 53/389.1, 53/389.2, 389.3, 389.4, 131.1, 411, 461; 493/341, 342, 372, 373; 412/4, 19, 24; 281/29, 281/34

See application file for complete search history.

(56) References Cited

U.S. PATENT DOCUMENTS

| | | | | | |
|---|---|---|---|---|---|
| 1,670,371 | A | * | 5/1928 | Massey | 229/92 |
| 2,232,640 | A | * | 2/1941 | Schwartzman | 156/251 |
| 2,646,914 | A | * | 7/1953 | Claff et al. | 229/182 |
| 2,726,706 | A | * | 12/1955 | Hakomaki | 156/515 |
| 2,943,336 | A | * | 7/1960 | Barrett et al. | 412/24 |
| 3,035,381 | A | * | 5/1962 | Hosso | 53/568 |
| 3,239,993 | A | | 3/1966 | Cherrin | |
| 3,378,991 | A | * | 4/1968 | Anderson | 53/329.3 |
| 3,466,214 | A | * | 9/1969 | Polk et al. | 156/213 |
| 3,496,700 | A | * | 2/1970 | McCabe et al. | 53/167 |
| 3,713,941 | A | * | 1/1973 | Saurs | 156/251 |
| 3,912,575 | A | * | 10/1975 | Zelnick | 156/515 |
| 3,943,031 | A | * | 3/1976 | Krueger et al. | 156/583.1 |
| 4,172,750 | A | * | 10/1979 | Giulie | 156/267 |
| 4,697,401 | A | * | 10/1987 | Kessler et al. | 53/459 |
| 4,860,523 | A | * | 8/1989 | Teteishi et al. | 53/512 |
| 5,056,295 | A | * | 10/1991 | Williams | 53/450 |
| 5,177,931 | A | * | 1/1993 | Latter | 53/133.3 |
| 5,177,937 | A | * | 1/1993 | Alden | 53/479 |
| 5,277,745 | A | * | 1/1994 | Williams | 156/583.1 |
| 5,893,822 | A | * | 4/1999 | Deni et al. | 53/512 |

(Continued)

FOREIGN PATENT DOCUMENTS

DE 4132681 4/1993

(Continued)

*Primary Examiner* — Paul R Durand
(74) *Attorney, Agent, or Firm* — Jacobson Holman PLLC

(57) ABSTRACT

A machine for covering articles with sheets of plastic material. The machine includes a device suitable for cutting and sealing the sheets that cooperate with a work plane and a guide suitable for arranging a roll of a continuous sheet of plastic material in a suitable position for unrolling subsequent portions of the continuous sheet and the positioning thereof on the work plane.

3 Claims, 6 Drawing Sheets

U.S. PATENT DOCUMENTS

| | | | | |
|---|---|---|---|---|
| 6,386,812 | B2 * | 5/2002 | Garlichs et al. | 412/19 |
| 6,499,271 | B1 * | 12/2002 | Lastovich et al. | 53/329.2 |
| 6,571,534 | B2 * | 6/2003 | De Young et al. | 53/329.2 |
| 6,613,178 | B1 * | 9/2003 | Di Bernardo | 156/267 |
| 7,370,455 | B2 * | 5/2008 | Dewey et al. | 53/329.3 |

FOREIGN PATENT DOCUMENTS

| | | |
|---|---|---|
| EP | 1142790 | 10/2001 |
| GB | 974827 | 11/1964 |
| WO | WO 03/004282 | 1/2003 |

* cited by examiner

MACHINE FOR COVERING VARIOUS TYPES OF ARTICLES

This is a national stage of PCT/EP06/064045 filed Jul. 10, 2006 and published in English.

FIELD OF THE INVENTION

The present invention relates to a machine for covering various types of articles.

BACKGROUND OF THE INVENTION

In the prior art machines are known for covering books with sheets of plastic material.

One of said machines is disclosed in patent application WO 03/004282. The machine comprises a sheet sealing and cutting assembly that cooperates with a work surface. The assembly comprises a first and a second element of which at least the first element is movable with respect to the other and the two elements are arranged on opposite sides of the work surface. The first element comprises a sealing and cutting blade having an electric current that passes through it and the second element comprises a sealing and cutting counterblade. Driving means is provided for moving the sealing and cutting blade from a rest position to an operating position in which the sealing and cutting blade engages with the sealing and cutting counterblade. The first element and the driving means belong to a unit connected to the work surface in a removable manner. The unit furthermore comprises elastic retaining means for retaining said blade in the rest position.

The plastic sheets that are used for covering the cover of a book are only single sheets of plastic as the machine does not accept a continuous single sheet of plastic material.

In this way, the operation of covering the numerous articles becomes tiresome for the user, who has to load a single sheet of plastic material for each operation.

Furthermore, the operation becomes costly, as the remaining part of the individual sheet of plastic material is no longer usable for covering another articles.

SUMMARY OF THE INVENTION

In view of the prior art, the object of the present invention is to provide a portable machine for covering various types of articles that overcomes the aforementioned drawbacks.

According to the present invention, this object is achieved by means of a machine for covering articles with sheets of plastic material, said machine comprising positioning means suitable for cutting and sealing the sheets that cooperate with a work plane, characterised in that it comprises means suitable for arranging a roll of a continuous sheet of plastic material in a position that is suitable for unrolling successive portions of said continuous sheet and placing them on said work plane.

BRIEF DESCRIPTION OF THE DRAWINGS

The features of the present invention will become clearer from the following description of embodiments thereof illustrated by way of non-limitative example in the attached drawings, in which.

DETAILED DESCRIPTION OF THE PREFERRED EMBODIMENTS

Figure 1:
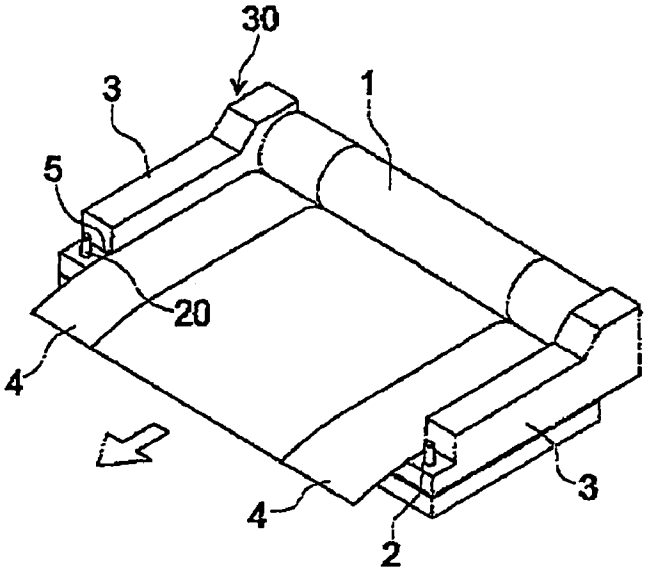
FIGS. 1-5 show the portable machine for covering various types of articles in various operating steps according to a first embodiment of the present invention.
Figure 2:
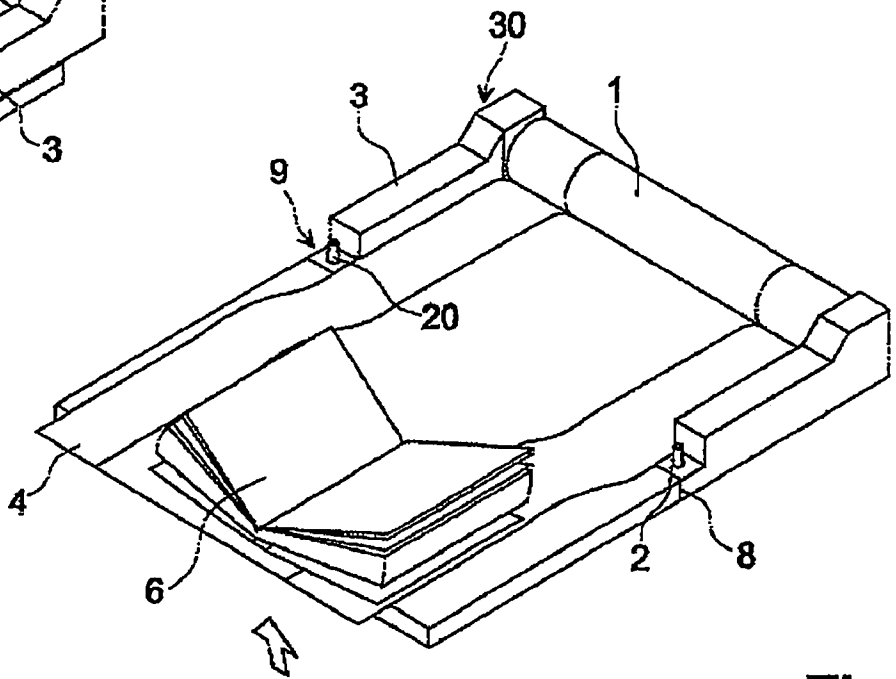
Figure 3:
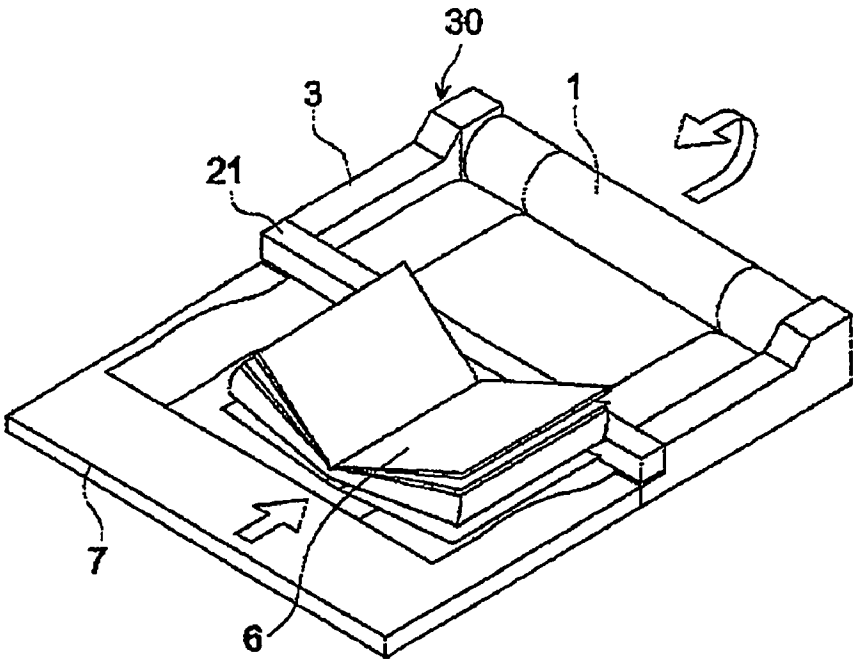

With reference to FIGS. 1-5 there is shown a machine for covering articles according to the first embodiment of the present invention. This machine uses a roll 1 of a continuous sheet of flexible plastic material of which successive portions of sheet suitable for covering articles of different type and in particular the covers of the books can be taken, and comprises a work plane or surface 2. The roll 1 is arranged adjacent the rear part 15 of the work plane 2.

The machine comprises means 30 for positioning the roll of the continuous sheet of plastic material; said positioning means 30 are integral with the work surface 2.

The work plane 2 comprises, on opposite side ends, protrusions 3 suitable for guiding the sheet of plastic material that is unwindable from the roll 1 (FIG. 1). The roll 1 does not have a structural core in cardboard or another material; the plastic material of the roll 1 has side flaps 4 between which the cover of an article, for example a book, is deposited, that have to face upwards. Preferably, as shown in FIGS. 1-5, the positioning means 30 are extensions of the protrusions 3.

The removed border of the sheet of plastic material must emerge from the work plane 2 at a distance that is such as to enable the book 6 (FIG. 2) to be positioned. The sheet of plastic material has to be arranged in slits 5 formed between the protrusions 3 and the work plane 2.

Preferably, the work plane 2 has an additional work plane 7, preferably hinged at 8 on the work plane 2, where the book 6 with the cover arranged inside a flap 4 of the sheet of plastic material is positioned.

Figure 6:
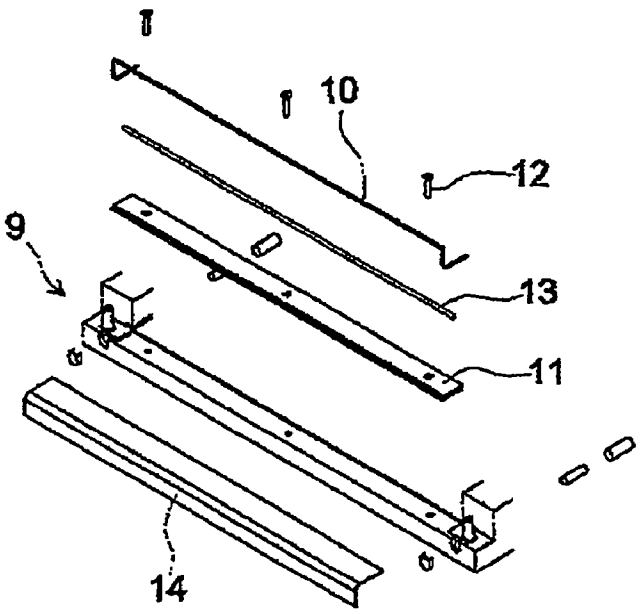
FIG. 6 is an exploded view of a part of the machine in FIG. 1.

In the front end 9 of the work plane 2, in the zone adjacent the end of the protrusions 3, there is a hot sealing and cutting blade 10 that is visible in FIG. 6. The blade 10 is arranged on a brass seat 11 fixed to the work plane 2 by means of screws 12; a layer of Teflon 13 is arranged between the blade 10 and the brass seat 11 and the blade 10 itself is covered by a further layer of Teflon 14. Electric current generated by an appropriate power supply unit that is not visible in the figures is passed through the blade 10.

On pins 20 arranged adjacent the ends of the blade 10 a welding and cutting counterblade 21 is suitable for engaging. The pins 20 also act as guides for the counterblade 21.

For cutting the sheet of plastic material, the roll 1 is rewound until it reaches the cutting zone of the sheet of plastic material. Subsequently, the counterblade 21 engages with the blade 10 in an operating or cutting position; lastly, the cut is performed by arranging the counterblade 21 on the coupling and guide pins 20 and exerting even pressure on the counterblade 21 (FIG. 3) towards the blade 10.

Figure 4:
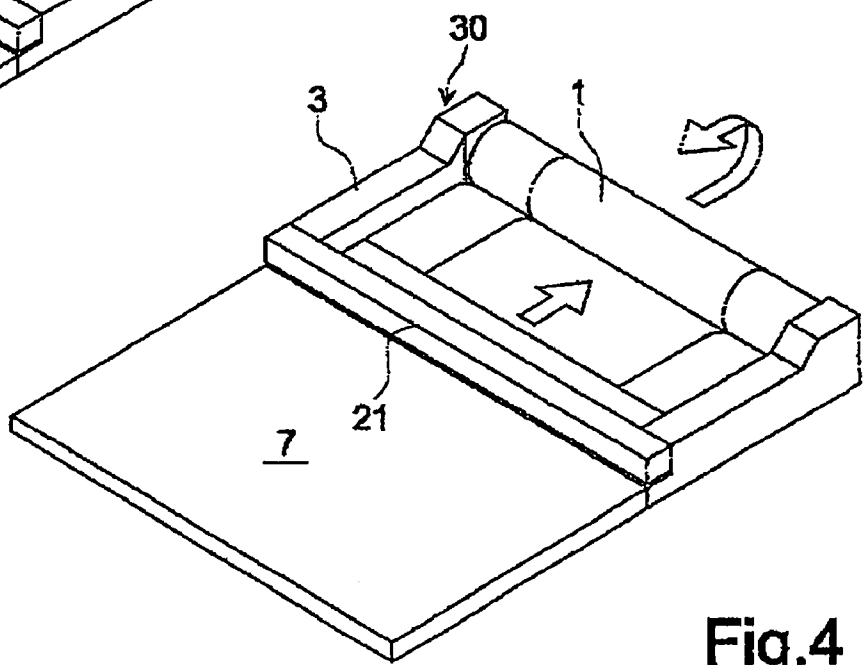
Figure 5:
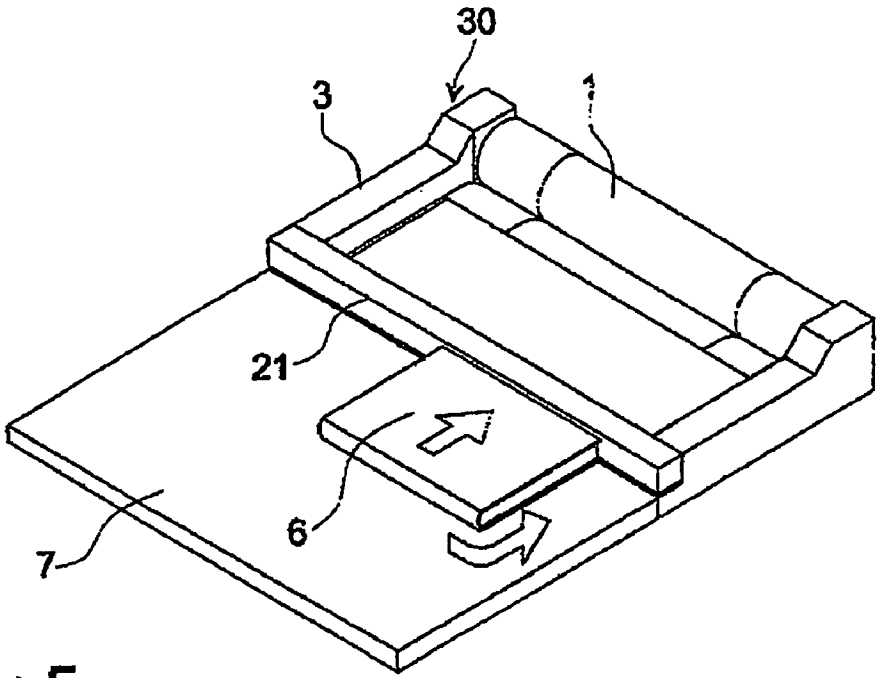

Subsequently, the roll 1 is rewound, but not completely, so as not to make the sheet of plastic material emerge from the slits 5 of the guides 3 (FIG. 4). In this way the work plane 2 is kept free for subsequent cuts of the sheet of plastic (FIG. 5).

Figure 7:
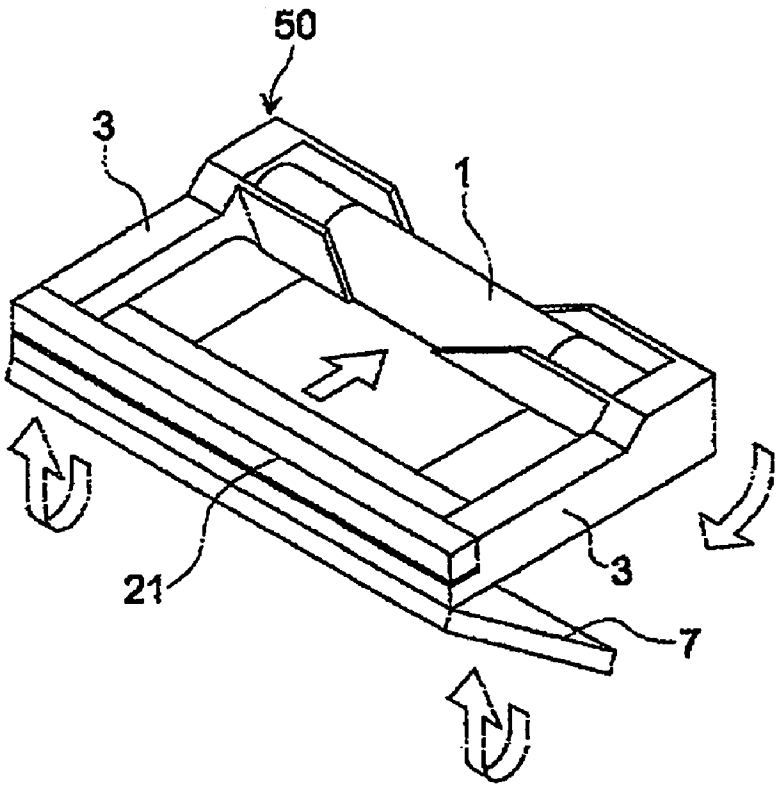
FIG. 7 is a portable machine according to a second embodiment of the invention.
Figure 9:
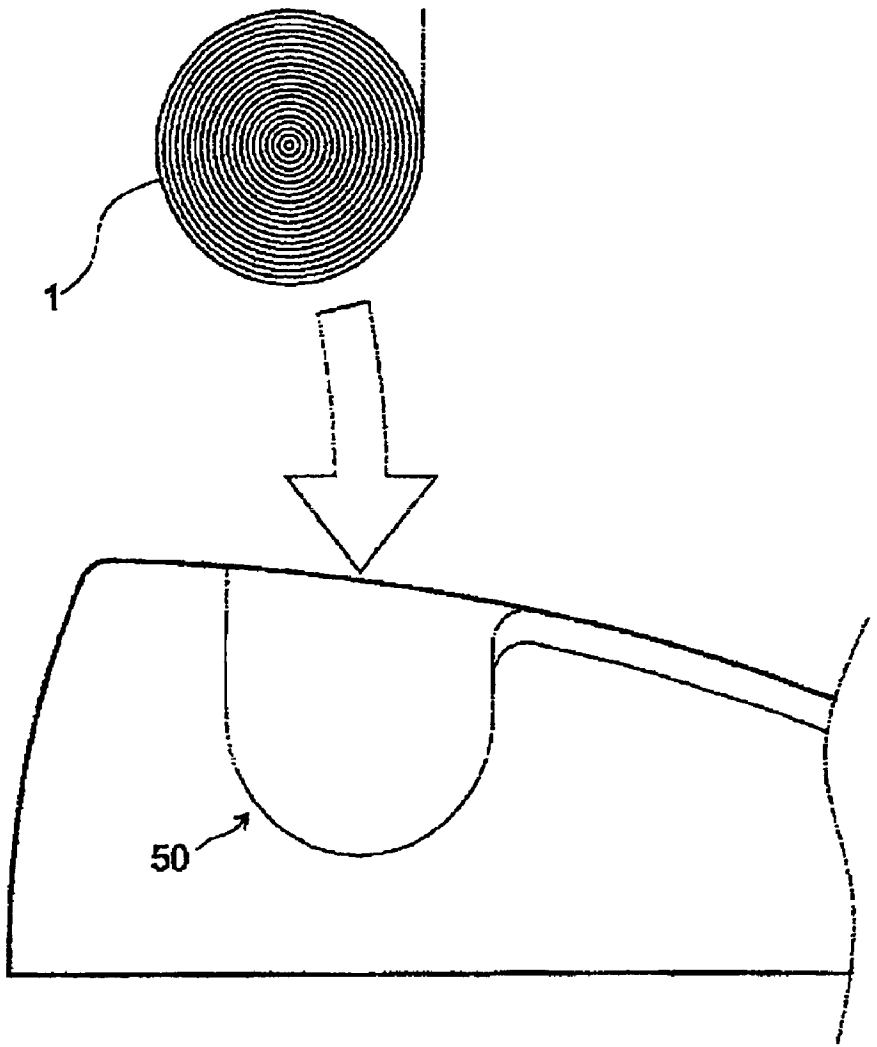
FIG. 9 is a schematic section view of the machine in FIG. 7.

FIGS. 7 and 9 show a second embodiment of the machine for covering various types of article according to the invention. The only difference between said machine with respect to the features of the machine in FIGS. 1-6 consists in that said positioning means comprise a gap 50 suitable for receiving the roll 1 of plastic material. Said gap is integral with the work plane 2.

Figure 8:
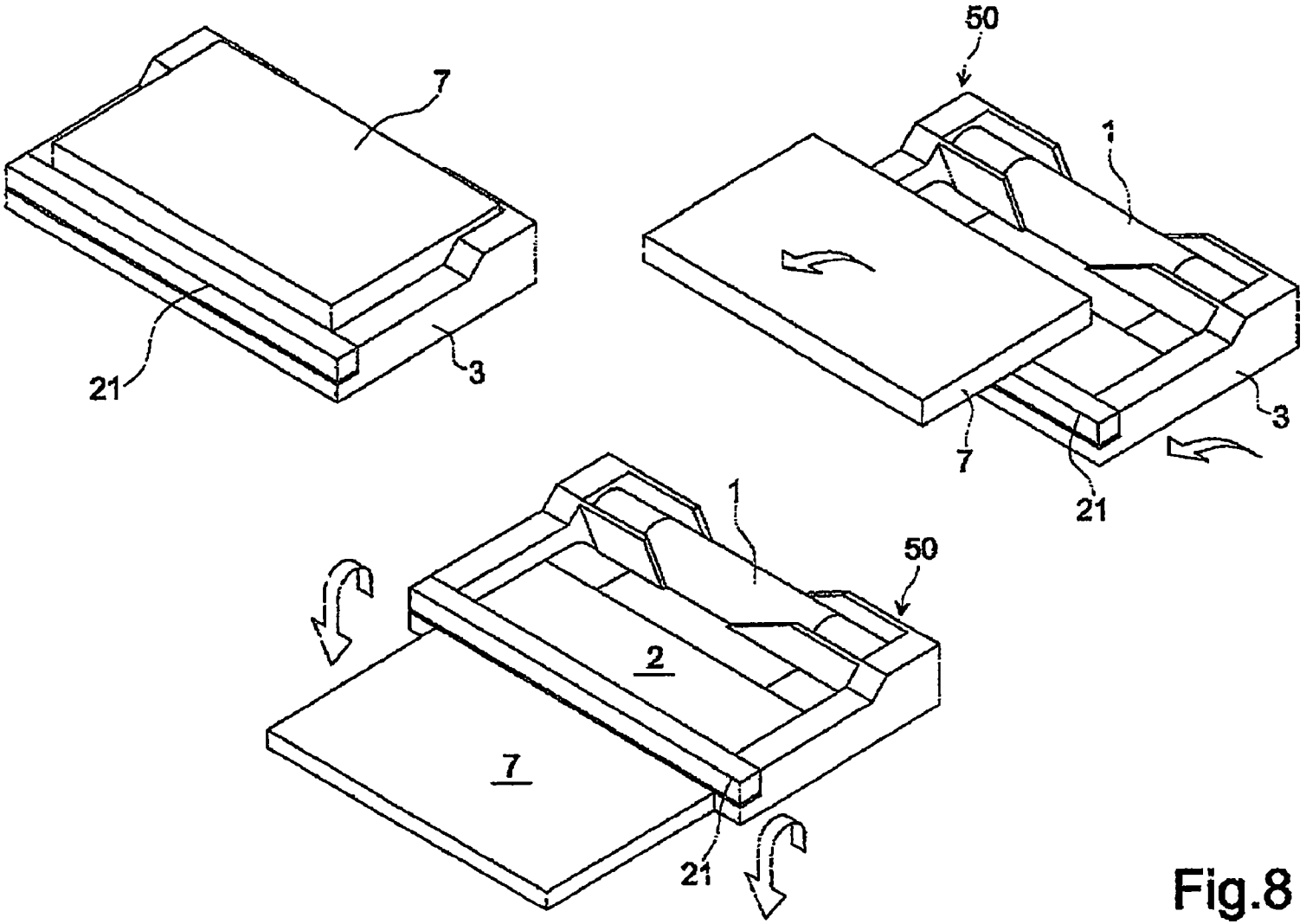
FIG. 8 is a portable machine according to a third embodiment of the invention.

In FIG. 8 there is shown a third embodiment of the machine for covering various types of articles according to the invention. The machine in FIG. 8 differs from the machine in FIG. 7 because the additional plane 7 is not hinged on the plane 9 but is detached therefrom to act as a closing element of the machine.

The invention claimed is:

1. A portable machine for covering articles with sheets of plastic material, said portable machine comprising a work plane, the work plane including a first plane and a second plane, the second plane being arranged at one of over and under the first plane in a position of rest, the first plane being hinged to the second plane, means for cutting and sealing the sheets, said cutting and sealing means cooperating with the work plane, positioning means located at one end of the work plane for arranging a roll of a continuous sheet of plastic material in a position for unrolling subsequent portions of said continuous sheet and placing the subsequent portions of the continuous sheet on said work plane, said means for cutting and sealing the work plane being spaced from said one end of the work plane, along the work plane, said positioning means being connected integrally with said work plane, said positioning means including side guides located at the working plane for the continuous sheet of plastic material, and slits located between the side guides and the work plane for receipt of, and guiding with the side guides, a leading edge of the continuous sheet of plastic material.

2. The portable machine according to claim 1, wherein said side guides of the sheet of plastic material are connected integrally to said positioning means of the roll.

3. The portable machine according to claim 1, wherein said positioning means includes a cavity for housing the roll.

* * * * *